US005203048A

United States Patent [19]

Bynum

[11] Patent Number: 5,203,048

[45] Date of Patent: Apr. 20, 1993

[54] GOLF CLUB HEAD BRUSH

[76] Inventor: Chandler K. Bynum, 361 London Blvd., Portsmouth, Va. 23704

[21] Appl. No.: 832,589

[22] Filed: Feb. 7, 1992

[51] Int. Cl.[5] ..... A46B 5/02
[52] U.S. Cl. ..... 15/160; 15/143.1
[58] Field of Search ..... 15/143.1, 159.1, 160, 15/210 R, 244.1

[56] References Cited

U.S. PATENT DOCUMENTS

| | | | |
|---|---|---|---|
| 1,398,864 | 11/1921 | Kelly | 15/171 |
| 2,221,128 | 11/1940 | Bates | 15/143 R |
| 2,276,078 | 3/1942 | Marks | 15/160 |
| 2,841,811 | 7/1958 | Carroll | 15/210 R |
| 3,047,896 | 4/1960 | Gunderson | 15/111 |
| 3,465,377 | 9/1969 | Thomas | 15/244.1 |
| 4,464,072 | 8/1984 | Norwell | 401/137 |
| 4,734,953 | 4/1988 | Dodson | 15/106 |
| 4,912,800 | 4/1990 | Zeltner | 15/114 |
| 4,923,316 | 5/1990 | Fattal | 401/11 |
| 4,940,349 | 7/1990 | van Rensburg | 401/10 |
| 4,971,126 | 11/1990 | Borenstein | 150/160 |
| 4,989,511 | 2/1991 | Clarke, Jr. | 15/143 R |
| 5,070,570 | 12/1991 | Sabo | 15/159 R |

FOREIGN PATENT DOCUMENTS

| | | | |
|---|---|---|---|
| 375267 | 7/1907 | France | 15/160 |

OTHER PUBLICATIONS

Modeon Plastics, vol. 31, No. 2, Oct. 1953, 122 pages, (Tek-Hughes Div.), Johnson & Johnson, New Brunswick, N.J.

*Primary Examiner*—Harvey C. Hornsby
*Assistant Examiner*—Randall E. Chin
*Attorney, Agent, or Firm*—Griffin Butler Whisenhunt & Kurtossy

[57] ABSTRACT

A golf club head brush (10) for cleaning a golf club head (38) comprises a relatively flat, generally-rectangular, handle (11) having opposite brush and non-brush sides (12,14) bounded by shaft, head, thumb and finger edges (26, 27, 18, 22), with brush bristles (28) mounted on the brush side directed outwardly away from the handle. The handle is constructed of a resilient material so as to be bendable. The brush and non-brush sides have the generally-rectangular shape, but include a thumb protrusion (16) at the thumb edge with bristles thereon. The shaft edge includes an outwardly flaring shaft slot (24) therein for receiving a shaft when the bristles are used to clean a golf club head.

3 Claims, 2 Drawing Sheets

GOLF CLUB HEAD BRUSH

BACKGROUND OF THE INVENTION

This invention relates broadly to brushes and more specifically to brushes for cleaning golf club heads.

There are many prior-art brushes intended for cleaning golf club heads. For example, U.S. Pat. No. 3,047,896 to Gunderson discloses a tool having bristles thereon for cleaning slots in a golf club head face. U.S. Pat. No. 4,923,316 to Fattal also describes a golf club cleaning device which one grips and rubs on a golf club head and U.S. Pat. No. 4,940,349 to Van Rensburg discloses a device into which golf club heads are inserted for cleaning. Some golf club head brushes are part of larger machines such as in the Van Rensburg patent. Some of these devices are rather complex, costly, and difficult for a golfer to carry with him while playing. Thus, it is an object of this invention to provide a golf club head brush which is inexpensive and uncomplicated, and which can be easily carried by a golfer while playing golf.

Most prior-art golf club head brushes which are intended to be carried by a golfer, either on his or her person or golf-club bag, while playing golf, are not very effective. Thus, it is object of this invention to provide a golf club head brush which not only can be easily carried during play, but which is quite effective in cleaning faces of golf club heads.

With regard to the problem that many prior-art golf club head brushes are not very effective in cleaning faces of golf club heads, usually every club a golfer carries when he plays is different from every other club. Thus, it is necessary that a golf club brush be shaped in a manner to accommodate the different golf club shapes. In this respect, each shaft of a golfer's clubs has a different angular relationship to the face of its head than the shafts of other clubs to their heads. When a golfer tries to clean the face of a club with a brush, the shaft often gets in the way and does not facilitate cleaning of the face of the club. It is therefore an object of this invention to provide a golf club head brush which accommodates different shaft angles relative to faces, using the various positions of the club shafts to enhance, or facilitate, the cleaning of club faces.

Yet another difficulty with many prior-art club head brushes is that it is difficult to hold them while cleaning grooves of a club face. Thus, it is an object of this invention to provide a golf club head brush which is easy to hold and manipulate while cleaning grooves of a golf club head face.

Still another problem with many prior-art golf club head brushes is that they are not very effective, often leaving debris in grooves. Therefore it is still another object of this invention to provide a golf club head brush which effectively cleans out grooves of golf club head faces.

SUMMARY OF THE INVENTION

According to principles of this invention, a golf club head brush comprises a relatively-flat, generally-rectangular, handle having opposite brush and non-brush sides bounded by shaft, head, thumb and finger edges. The handle is constructed of a resilient material so as to be bendable. The brush and non-brush sides have generally rectangular shapes, but also include a thumb protrusion at the thumb edge, finger notches at the finger edge, and an outwardly-flaring, tapered shaft slot at the shaft edge.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
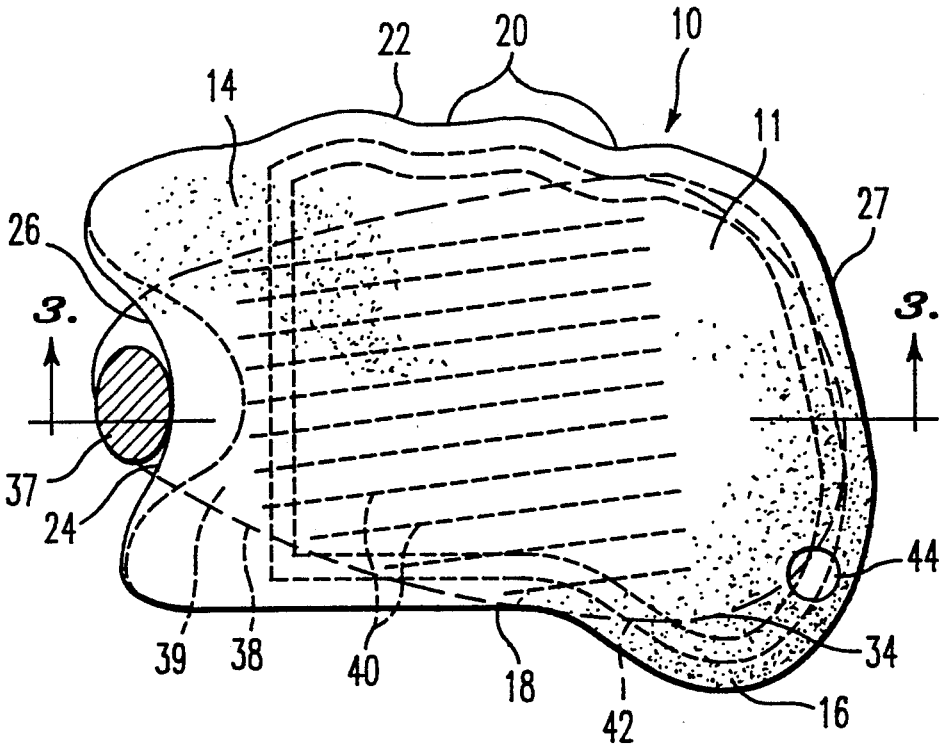
FIG. 1 is a top view of the golf club head brush of this invention with a face of a golf club head depicted thereunder, the shaft of the golf club being shown in section.
Figure 2:
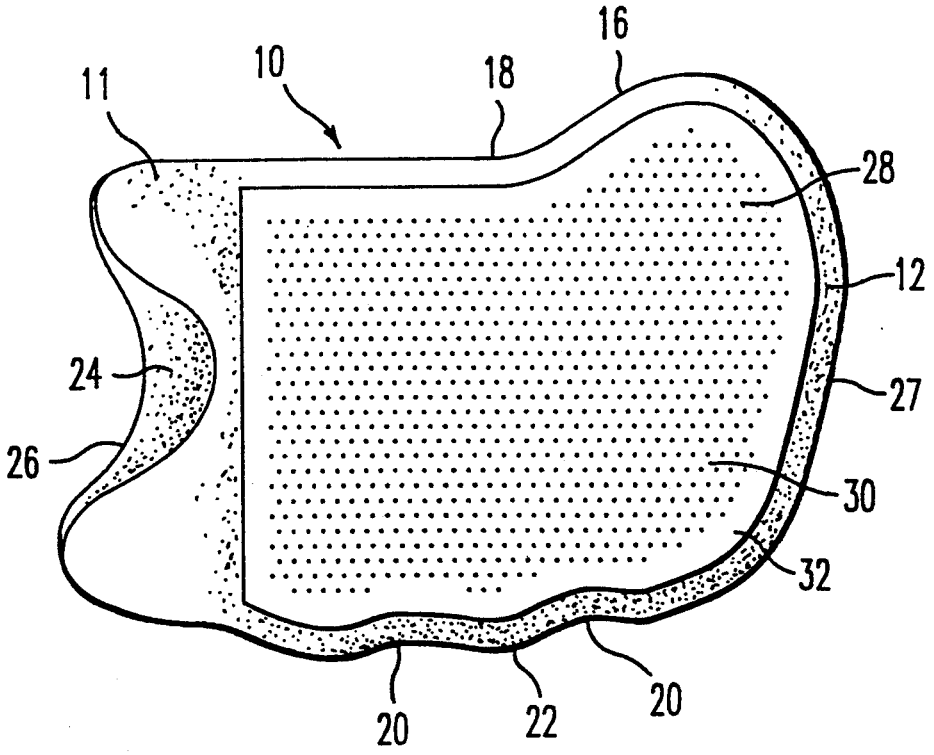
FIG. 2 is a bottom view of the golf club head brush of this invention.
Figure 3:
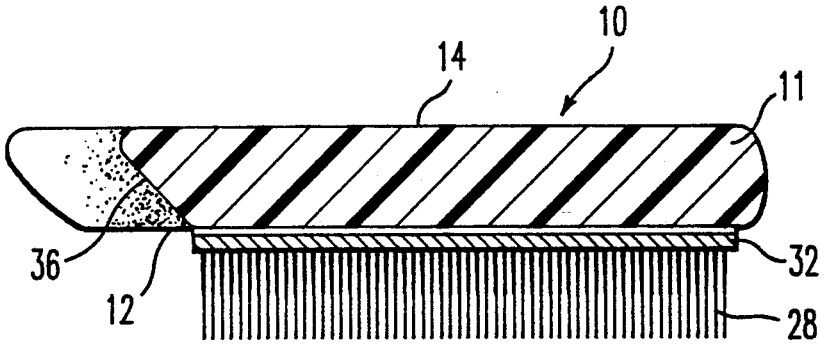
FIG. 3 is a cross-sectional view taken on line 3—3 in FIG. 1.
Figure 4:
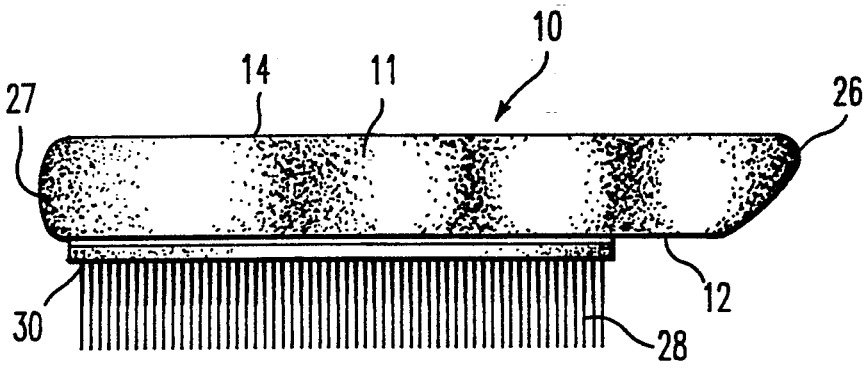
FIG. 4 is a side elevational view showing a finger edge of the golf club head brush of this invention.
Figure 5:
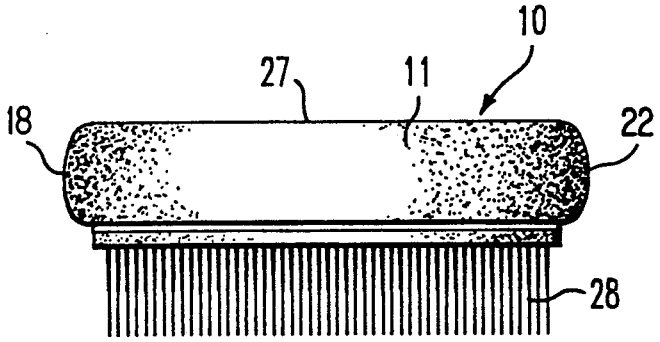
FIG. 5 is a head-end elevational view of the golf club head brush of this invention.
Figure 6:
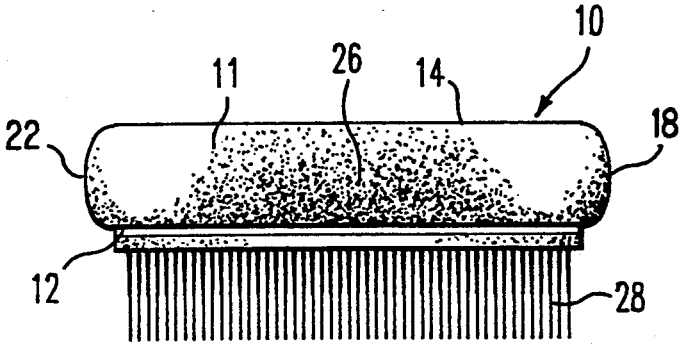
FIG. 6 is a shaft-end elevational view of the golf club head brush of this invention.

A golf club head brush 10 has a brush side 12, ad a non-brush side 14. Both the brush side 12 and the non-brush side 14 generally have a rectangular shape, but with a thumb protrusion 16 in a thumb edge 18, finger notches 20 in a finger edge 22, and a flared shaft slot 24 in a shaft edge 26. A head edge 27, opposite the shaft edge 26 completes the generally rectangular shape. The relatively flat handle 11 is constructed of a hard resilient material such as Nylon plastic. Brush bristles 28 are mounted on the brush side 12 in a bristle area 30 to extend outwardly, or downwardly, away from the brush side 12 from the handle 11. In the depicted embodiment, the bristles are mounted on a bristle pad 32 which, in turn, is mounted on the brush side 12 of the handle 11, however, the bristles can be mounted directly on the handle itself. It should be noted that the bristle area 30 including bristles 28 extends laterally at 34 into the thumb protrusion 16.

The flared shaft slot 24 includes a taper 36 extending outwardly from the brush side 12 to the non-brush side 14.

The flared shaft slot 24 has a shape and size for receiving a shaft 37 of a normal iron golf club 38. The thumb protrusion 16 has a shape such that it can be easily engaged by a thumb of a user while the finger notches 20 of the handle 11 can be easily engaged by fingers of the same hand of the user for gripping the handle 11 and moving the outer ends of the bristles 28 across the face of the golf club head 39. In this regard, the flared shaft slot 24 engages the shaft of a golf club being cleaned and thereby guides a user to naturally move the bristles 28 in a correct direction across the face of a club for cleaning grooves 40 therein. In this respect, the flared shaft slot 24, being flared, causes the handle to guidingly engage the shaft to cause the brush pad to be properly aligned with the golf club head and its grooves while it is being used to clean the face of the head.

It should be appreciate by those of ordinary skill in the art that not only do the thumb protrusion 16 and the finger notches 20 make it easy for a user to more effectively grip and manipulate the handle 11 of the brush 10, but the thumb protrusion 16, with its bristles, also contribute to proper cleaning of the face of the club head 38 by covering a flared upper, or top, edge portion 42 of the golf club head. That is, the contour of the brush comes closer to matching that of a club head than it if were purely rectangular.

It is quite advantageous that the brush handle 11 is constructed of a resilient material such that when its shaft edge 26 contacts a shaft 37 it flexes to allow continued movement of the bristles 28 toward the shaft 37, without scratching or otherwise damaging the shaft. At the same time, it is beneficial that the shaft edge 26 has the flared shaft slot 24 which channels the golf club brush against the shaft while properly orienting the golf club brush on the club head face 32. In the same manner, it is extremely beneficial that at an apex of the flared shaft slot the shaft edge 26 has the outward taper 36 from the brush side 12 to the non-brush side 14 because this taper accommodates an angle at which most shafts extend away from faces of their club heads thereby also making it easier to move the golf club head brush toward a shaft along a face of a golf club.

It can be appreciated that the golf club head brush of this invention can be easily carried by a golfer since it does not have any working part and is relatively flexible. Also, the golf club head brush of this invention can be relatively small, extending about the length and width of a golf club head. Thus, it is possible to make the golf club head brush of this invention about the size of a normal iron golf club head.

Since the handle of the golf club head brush of this invention is resilient, the golf club head brush can be easily used with all types and shapes of golf clubs without damaging them while reaching all areas which must be cleaned.

Further, by making the handle of the golf club head brush of this invention with easily gripped finger and thumb notches it is quite easy for a golfer to manipulate it for cleaning a golf club head. Similarly, including bristles on the thumb protrusion also provides additional bristles for cleaning a golf club head in a shape which conforms to the shape of most golf club heads.

While the invention has been particularly shown and described with reference to a preferred embodiment, it will be understood by those skilled in the art that various changes in form and detail may be made therein without departing from the spirit and scope of the invention. For example, a hole 44 could be placed through the handle 11, to which a cord can be tied for attaching the golf club head brush to something, such as a golf club bag.

The embodiments of the invention in which an exclusive property or privilege are claimed and defined as follows:

1. A brush for cleaning golf club heads comprising a relatively flat, generally rectangular handle having opposite brush and non-brush sides, said handle defining shaft, thumb, head and finger edges bounding said brush and non-brush sides in this order in a counter-clockwise direction when viewed from the non-brush side, said brush further including brush bristles mounted on said brush side to be directed outwardly away from said handle, said brush and non-brush sides having said generally rectangular shape and being approximately of a size of a golf-club-head face, but of an approximate contoured non-symmetrical shape of said golf-club-head face, said shape including a thumb protrusion at an end of the thumb edge near the head edge, said thumb and finger edges being opposite one another whereby said brush handle can be easily gripped by a thumb on the thumb protrusion and by other fingers of a same hand on the finger edge, a shaft slot formed in said shaft edge;

wherein said shaft edge of said handle defines an outwardly flaring shaft slot of a size and shape for receiving a club shaft; and wherein said shaft edge tapers outwardly from said brush side to said non-brush side of said handle at an apex of said shaft slot to permit the entire face of the club to be cleaned.

2. A brush as in claim 1 wherein said handle further defines a finger notch in the finger edge thereof.

3. A brush as in claim 1 wherein said handle is constructed of a resilient material so as to be bendable.

* * * * *